US010626822B2

(12) United States Patent
Harada et al.

(10) Patent No.: US 10,626,822 B2
(45) Date of Patent: Apr. 21, 2020

(54) VALVE OPERATING SYSTEM FOR MULTICYLINDER ENGINE

(71) Applicant: HONDA MOTOR CO., LTD., Tokyo (JP)

(72) Inventors: Takeya Harada, Wako (JP); Kiyohiko Masago, Wako (JP); Masaru Kawano, Wako (JP); Naoya Ashita, Wako (JP); Kei Ueda, Wako (JP); Koji Katsumata, Wako (JP); Koichi Ogino, Wako (JP); Hitoshi Ouchi, Wako (JP)

(73) Assignee: HONDA MOTORS CO., LTD., Tokyo (JP)

( * ) Notice: Subject to any disclaimer, the term of this patent is extended or adjusted under 35 U.S.C. 154(b) by 110 days.

(21) Appl. No.: 15/896,246

(22) Filed: Feb. 14, 2018

(65) Prior Publication Data

US 2018/0274478 A1 Sep. 27, 2018

(30) Foreign Application Priority Data

Mar. 24, 2017 (JP) ..... 2017-059570

(51) Int. Cl.

| | |
|---|---|
| ***F02F 1/42*** | (2006.01) |
| ***F01L 1/18*** | (2006.01) |
| ***F01L 1/047*** | (2006.01) |
| ***F01L 13/00*** | (2006.01) |
| ***F01L 1/26*** | (2006.01) |
| ***F01L 1/02*** | (2006.01) |

(Continued)

(52) U.S. Cl.

CPC ..... *F02F 1/4214* (2013.01); *F01L 1/026* (2013.01); *F01L 1/047* (2013.01); *F01L 1/053* (2013.01);

(Continued)

(58) Field of Classification Search

CPC ..... F02F 1/4214; F01L 1/026; F01L 1/047; F01L 1/053; F01L 1/182; F01L 1/185;

(Continued)

(56) References Cited

U.S. PATENT DOCUMENTS 3,924,590 A 12/1975 Miyaki et al.
4,488,520 A 12/1984 Almor (Continued)

FOREIGN PATENT DOCUMENTS

CN 2471932 Y 1/2002
CN 202348361 U 7/2012

(Continued)

OTHER PUBLICATIONS

Office Action dated Oct. 24, 2019, issued in counterpart IN Application No. 201844009899, with English translation. (6 pages).

(Continued)

*Primary Examiner* — Patrick Hamo

*Assistant Examiner* — Kelsey L Stanek

(74) *Attorney, Agent, or Firm* — Westerman, Hattori, Daniels & Adrian, LLP

(57) ABSTRACT

A valve operating system for a multicylinder engine opens and closes a pair of valves provided on each of cylinders by means of a pair of rocker arms operated by a cam provided on a camshaft supported on a cam holder. When viewed in a direction of a cylinder axis, the pair of rocker arms of at least one of the cylinders are inclined in opposite directions to each other with respect to a direction orthogonal to a camshaft axis. Therefore, thrust loads acting on the camshaft from the pair of rocker arms are counteracted individually for each of the cylinders, thereby enabling the thrust load to be reduced and axial movement of the camshaft to be prevented.

9 Claims, 9 Drawing Sheets

(51) Int. Cl.
*F01L 1/053* (2006.01)
*F01L 1/24* (2006.01)

(52) U.S. Cl.
CPC ..... *F01L 1/182* (2013.01); *F01L 1/185* (2013.01); *F01L 1/267* (2013.01); *F01L 13/0021* (2013.01); *F01L 13/0036* (2013.01); *F01L 1/2405* (2013.01); *F01L 2001/0476* (2013.01); *F01L 2001/054* (2013.01); *F01L 2001/0537* (2013.01); *F01L 2105/00* (2013.01); *F01L 2810/04* (2013.01)

(58) Field of Classification Search
CPC ..... F01L 1/267; F01L 1/2405; F01L 13/0021; F01L 13/0036; F01L 2001/0476; F01L 2001/0537; F01L 2001/054; F01L 2105/00; F01L 2810/04; F01L 2001/0473; F01L 1/08; F01L 1/46
USPC ..... 123/90.16
See application file for complete search history.

(56) References Cited

U.S. PATENT DOCUMENTS

| | | | | |
|---|---|---|---|---|
| 4,848,284 | A | 7/1989 | Konno | |
| 5,537,963 | A | 7/1996 | Hasebe et al. | |
| 5,596,958 | A | 1/1997 | Miller | |
| 2004/0168658 | A1 | 9/2004 | Sakai et al. | |
| 2018/0179921 | A1 * | 6/2018 | Yano | F01L 1/185 |

FOREIGN PATENT DOCUMENTS

| | | | | | |
|---|---|---|---|---|---|
| CN | 103195602 | A | | 7/2013 | |
| CN | 108240243 | A | | 7/2018 | |
| JP | S6318113 | A | | 1/1988 | |
| JP | 2018105174 | A | * | 7/2018 | F01L 1/185 |

OTHER PUBLICATIONS

Office Action dated Dec. 16, 2019, issued in counterpart Chinese application No. 201810233800.6, with English translation (13 pages).

* cited by examiner

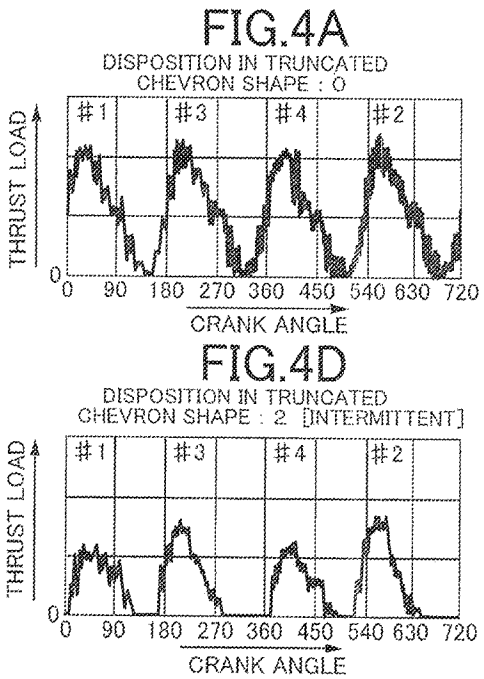
FIG.4A
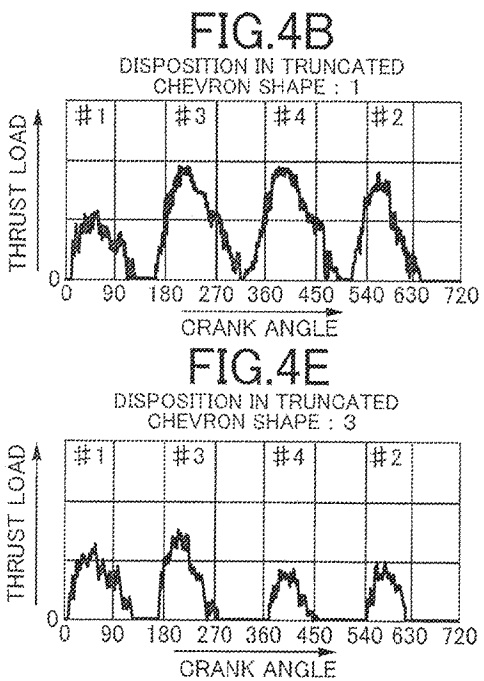
FIG.4B
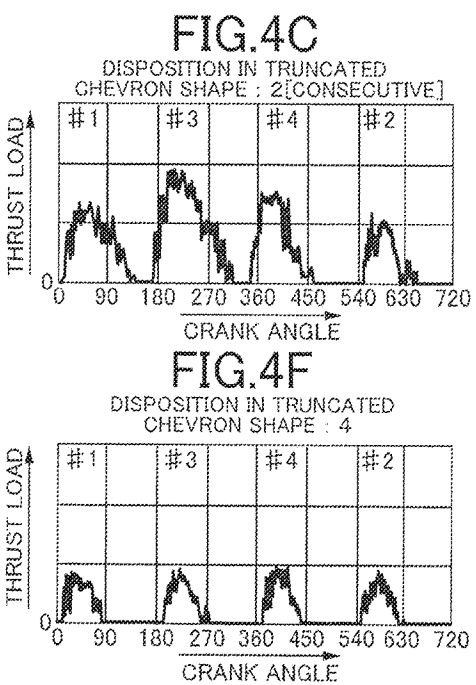
FIG.4C
FIG.4D
FIG.4E
FIG.4F
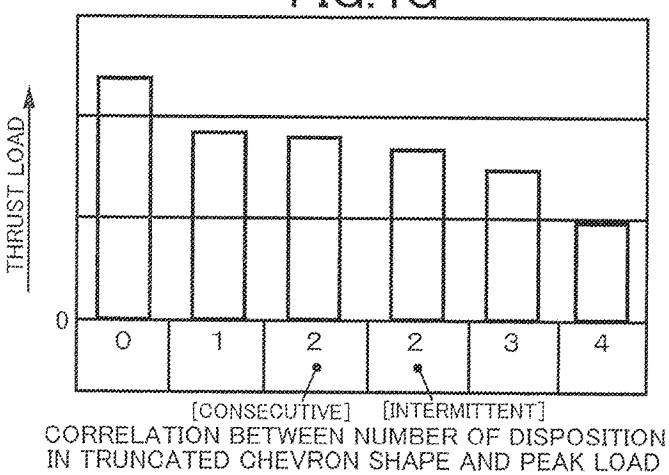
FIG.4G
CORRELATION BETWEEN NUMBER OF DISPOSITION IN TRUNCATED CHEVRON SHAPE AND PEAK LOAD

WHEN VALVE IS OPENED

WHEN VALVE IS CLOSED

VALVE OPERATING SYSTEM FOR MULTICYLINDER ENGINE

BACKGROUND OF THE INVENTION

Field of the Invention

The present invention relates to a valve operating system for a multicylinder engine, that opens and closes a pair of valves provided on each of cylinders by means of a pair of rocker arms operated by a cam provided on a camshaft supported on a cam holder.

Description of the Related Art

A valve operating system for an engine that opens and closes an air intake valve or an exhaust valve of the engine includes a camshaft that rotates in synchronism with rotation of a crankshaft and a rocker arm that abuts against a cam provided on the camshaft and swings, and the air intake valve and the exhaust valve are made to open and close by being pushed by the swinging rocker arm.

Transmission of driving force from the camshaft to the rocker arm is carried out by abutment between the cam provided on the camshaft and a roller provided on the rocker arm; if the longitudinal direction of the rocker arm is not correctly orthogonal to the axis of the camshaft due to dimensional error or assembly error, an unbalanced thrust load will act on the camshaft from the rocker arm due to the reaction force load when the cam pushes down the roller, and there are the problems that a knocking sound will occur when the camshaft moves in the axial direction and collides with a cam holder and the reliability will be degraded due to wear of the contacting parts.

SUMMARY OF THE INVENTION

The present invention has been accomplished in light of the above circumstances, and it is an object thereof to enable a thrust load that acts on a camshaft from a rocker arm in a valve operating system of a multicylinder engine to be controlled.

In order to achieve the object, according to a first aspect of the present invention, there is provided a valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms of at least one of the cylinders are inclined in opposite directions to each other with respect to a direction orthogonal to a camshaft axis.

In accordance with the first aspect, the valve operating system for a multicylinder engine opens and closes the pair of valves provided on each cylinder by means of the pair of rocker arms operated by the cam provided on the camshaft supported on the cam holder. Moreover, when viewed in the direction of the cylinder axis, the pair of rocker arms of at least one cylinder are inclined in opposite directions to each other with respect to a direction orthogonal to the camshaft axis, and the thrust loads acting on the camshaft from the pair of rocker arms are therefore counteracted individually for each of the cylinders, thereby enabling the thrust load to be reduced and axial movement of the camshaft to be prevented.

According to a second aspect of the present invention, there is provided a valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms of at least one of the cylinders are inclined in a same direction as each other with respect to a direction orthogonal to a camshaft axis.

In accordance with the second aspect, the valve operating system for a multicylinder engine opens and closes the pair of valves provided on each cylinder by means of the pair of rocker arms operated by the cam provided on the camshaft supported on the cam holder. Moreover, when viewed in the direction of the cylinder axis, the pair of rocker arms of at least one cylinder are inclined in the same direction as each other with respect to a direction orthogonal to the camshaft axis, and the directions of the thrust load acting on the camshaft from the pair of rocker arms are therefore made uniform for each cylinder, thereby pushing the camshaft against the cam holder and enabling axial movement to be prevented.

According to a third aspect of the present invention, there is provided a valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, and directions of inclination of the rocker arms of two of the cylinders for which a firing order is consecutive are in opposite directions to each other.

In accordance with the third aspect, the valve operating system for a multicylinder engine opens and closes the pair of valves provided on each cylinder by means of the pair of rocker arms operated by the cam provided on the camshaft supported on the cam holder. Moreover, when viewed in the direction of the cylinder axis, the pair of rocker arms are inclined in the same direction as each other with respect to a direction orthogonal to the camshaft axis, the directions of inclination of the rocker arms of two of the cylinders for which the firing order is consecutive are in opposite directions to each other, and the thrust loads acting on the camshaft from the rocker arms of the two cylinders are therefore counteracted, thereby enabling the thrust load to be reduced and axial movement of the camshaft to be prevented.

According to a fourth aspect of the present invention, there is provided a valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, and directions of inclination of the rocker arms of two of the cylinders for which a firing order is consecutive are in a same direction as each other.

In accordance with the fourth aspect, the valve operating system for a multicylinder engine opens and closes the pair of valves provided on each cylinder by means of the pair of rocker arms operated by the cam provided on the camshaft supported on the cam holder. Moreover, when viewed in the direction of the cylinder axis, the pair of rocker arms are inclined in the same direction as each other with respect to a direction orthogonal to the camshaft axis, the directions of inclination of the rocker arms of two of the cylinders for which the firing order is consecutive are in the same direction as each other, and the directions of the thrust load acting on the camshaft from the rocker arms of the two cylinders are therefore made uniform, thereby pushing the camshaft against the cam holder and enabling axial movement to be prevented.

According to a fifth aspect of the present invention, there is provided a valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, a direction of inclination of the rocker arm driven by the camshaft on an air intake side and a direction of inclination of the rocker arm driven by the camshaft on an exhaust side are in a same direction as each other, a helical gear on the air intake side provided on the camshaft on the air intake side and a helical gear on the exhaust side provided on the camshaft on the exhaust side mesh with each other, a thrust load generated by the helical gear on the air intake side is in a direction opposite to that of a thrust load generated by the rocker arm on the air intake side, and a thrust load generated by the helical gear on the exhaust side is in a direction opposite to that of a thrust load generated by the rocker arm on the exhaust side.

In accordance with the fifth aspect, the valve operating system for a multicylinder engine opens and closes the pair of valves provided on each cylinder by means of the pair of rocker arms operated by the cam provided on the camshaft supported on the cam holder. Moreover, when viewed in the direction of the cylinder axis, the pair of rocker arms are inclined in the same direction as each other with respect to a direction orthogonal to the camshaft axis, the direction of inclination of the rocker arm driven by the camshaft on the air intake side and the direction of inclination of the rocker arm driven by the camshaft on the exhaust side are in the same direction as each other, the helical gear on the air intake side provided on the camshaft on the air intake side and the helical gear on the exhaust side provided on the camshaft on the exhaust side mesh with each other, the thrust load generated by the helical gear on the air intake side is in a direction opposite to that of the thrust load generated by the rocker arm on the air intake side, the thrust load generated by the helical gear on the exhaust side is in a direction opposite to that of the thrust load generated by the rocker arm on the exhaust side, and the thrust loads acting on the camshaft on the air intake side and the camshaft on the exhaust side are therefore counteracted by the thrust loads generated by the helical gear on the air intake side and the helical gear on the exhaust side respectively, thereby enabling the thrust load to be reduced and axial movement of the camshaft on the air intake side and the camshaft on the exhaust side to be prevented.

According to a sixth aspect of the present invention, there is provided a valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, a direction of inclination of the rocker arm driven by the camshaft on the air intake side and a direction of inclination of the rocker arm driven by the camshaft on the exhaust side are in a same direction as each other, a helical gear on the air intake side provided on the camshaft on the air intake side and a helical gear on the exhaust side provided on the camshaft on the exhaust side mesh with each other, a thrust load generated by the helical gear on the air intake side is in a same direction as that of a thrust load generated by the rocker arm on the air intake side, and a thrust load generated by the helical gear on the exhaust side is in a same direction as that of a thrust load generated by the rocker arm on the exhaust side.

In accordance with the sixth aspect, the valve operating system for a multicylinder engine opens and closes the pair of valves provided on each cylinder by means of the pair of rocker arms operated by the cam provided on the camshaft supported on the cam holder. Moreover, when viewed in the direction of the cylinder axis, the pair of rocker arms are inclined in the same direction as each other with respect to a direction orthogonal to the camshaft axis, the direction of inclination of the rocker arm driven by the camshaft on the air intake side and the direction of inclination of the rocker arm, driven by the camshaft on the exhaust side are in the same direction as each other, the helical gear on the air intake side provided on the camshaft on the air intake side and the helical gear on the exhaust side provided on the camshaft on the exhaust side mesh with each other, the thrust load generated by the helical gear on the air intake side is in the same direction as that of the thrust load generated by the rocker arm on the air intake side, the thrust load generated by the helical gear on the exhaust side is in the same direction as that of the thrust load generated by the rocker arm on the exhaust side, and the thrust loads acting on the camshaft on the air intake side and the camshaft on the exhaust side are therefore biased by means of the thrust loads generated by the helical gear on the air intake side and the helical gear on the exhaust side respectively, thereby pushing the camshaft on the air intake side and the camshaft on the exhaust side against the cam holder and enabling axial movement to be prevented.

According, to a seventh aspect of the present invention, in addition to any one of the first to sixth aspects, the rocker arm is inclined with respect to a direction orthogonal to the camshaft axis by displacing a position of a fulcrum of the rocker arm in a direction of the camshaft axis.

In accordance with the seventh aspect, since the rocker arm is inclined with respect to a direction orthogonal to the camshaft axis by displacing the position of the fulcrum of the rocker arm in the direction of the camshaft axis, it is possible to incline the rocker arm without changing the design of the existing rocker arm.

According to an eighth aspect of the present invention, in addition to any one of the first to sixth aspects, the rocker arm comprises a roller that abuts against the cam, and the rocker arm is inclined with respect to a direction orthogonal to the camshaft axis by inclining an axis of the roller with respect to a longitudinal direction of the rocker arm.

In accordance with the eighth aspect, since the rocker arm includes the roller, which abuts against the cam, and the rocker arm is inclined with respect to a direction orthogonal to the camshaft axis by inclining the axis of the roller with respect to the longitudinal direction of the rocker arm, it is possible to incline the rocker arm without changing the design of the existing cylinder head.

Note that an air intake valve 13I and an exhaust valve 13E of embodiments correspond to the valve of the present invention, an air intake rocker arm 16I and an exhaust rocker arm 16E of the embodiments correspond to the rocker arm of the present invention, an air intake camshaft 20I and an exhaust camshaft 20E of the embodiments correspond to the camshaft of the present invention, an air intake cam 21I and an exhaust cam 21E of the embodiments correspond to the cam of the present invention, an air intake helical gear 22I and an exhaust helical gear 22E of the embodiments correspond to the helical gear of the present invention.

The above and other objects, characteristics and advantages of the present invention will be clear from detailed descriptions of the preferred embodiments which will be provided below while referring to the attached drawings.

BRIEF DESCRIPTION OF THE DRAWINGS

FIGS. 4A to 4G are graphs showing the thrust load of an air intake camshaft of each cylinder generated by a rocker arm. (first embodiment)

DESCRIPTION OF THE PREFERRED EMBODIMENTS

First Embodiment

A first embodiment of the present invention is explained below by reference to FIGS. 1 to 4G. The first embodiment corresponds to the invention of claim 1 of the present application.

Figure 1:
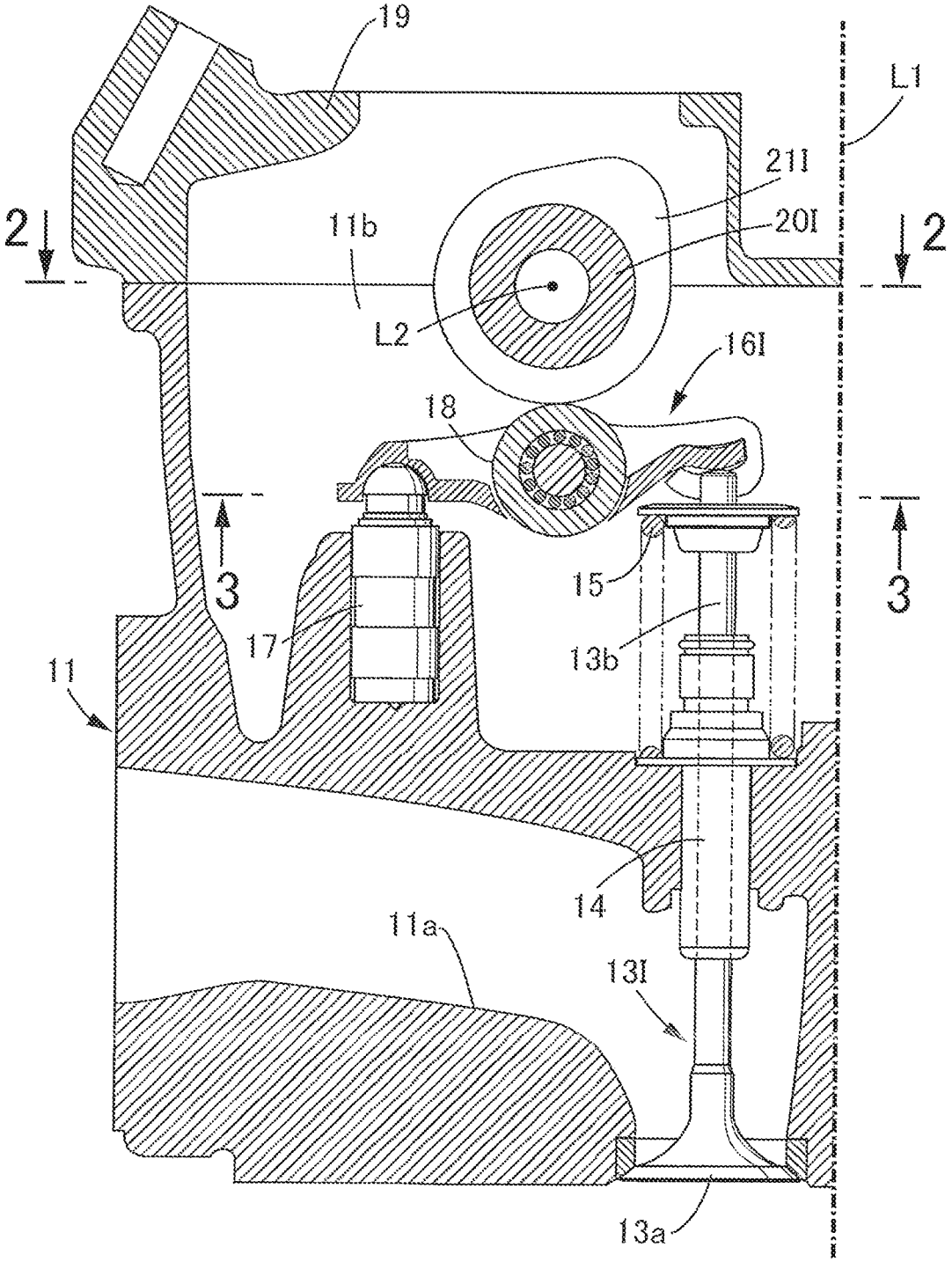
FIG. 1 is a longitudinal sectional view of a cylinder head of an engine. (first embodiment)
Figure 2:
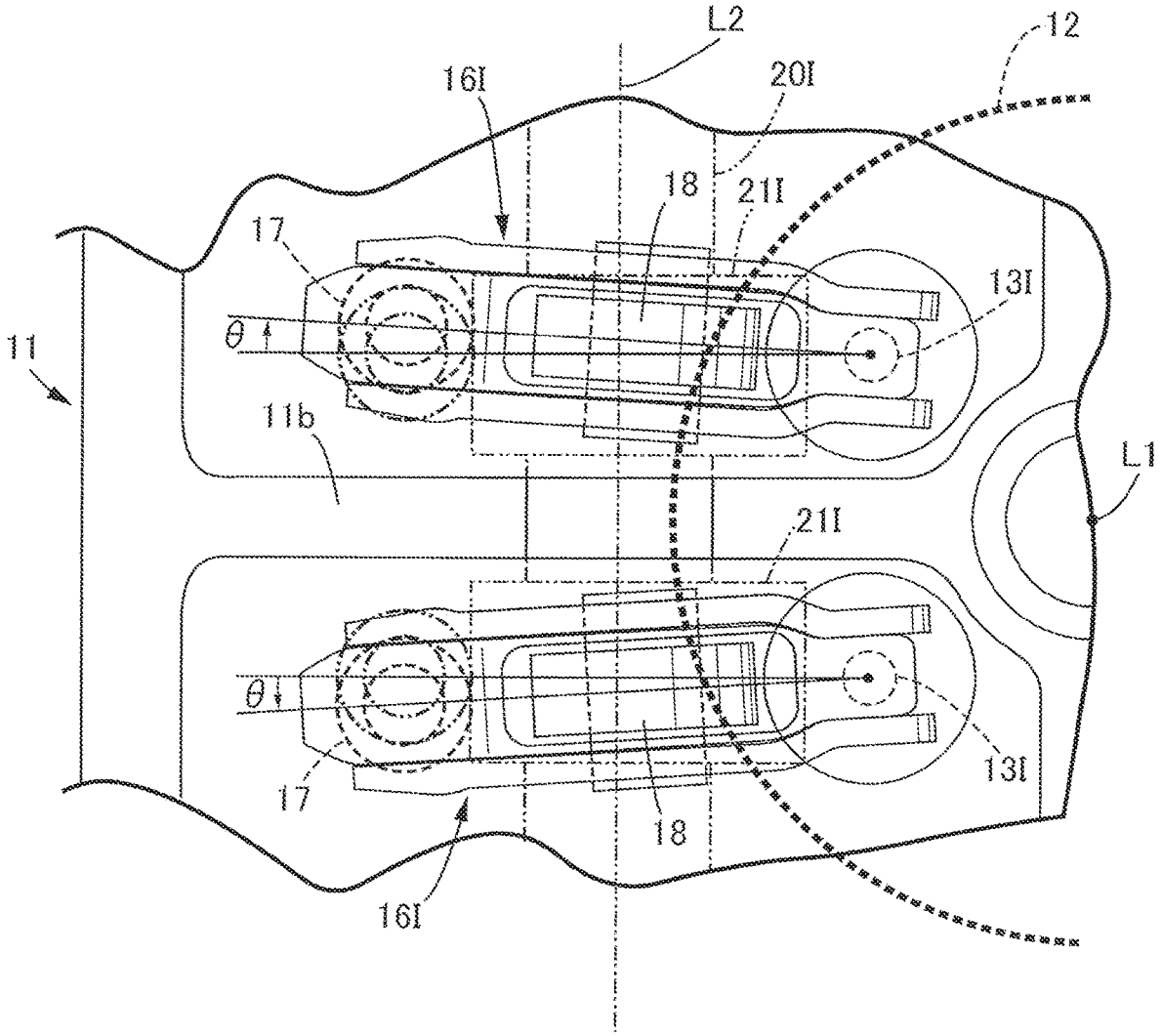
FIG. 2 is a view from arrowed line 2-2 in FIG. 1. (first embodiment)
Figure 3:
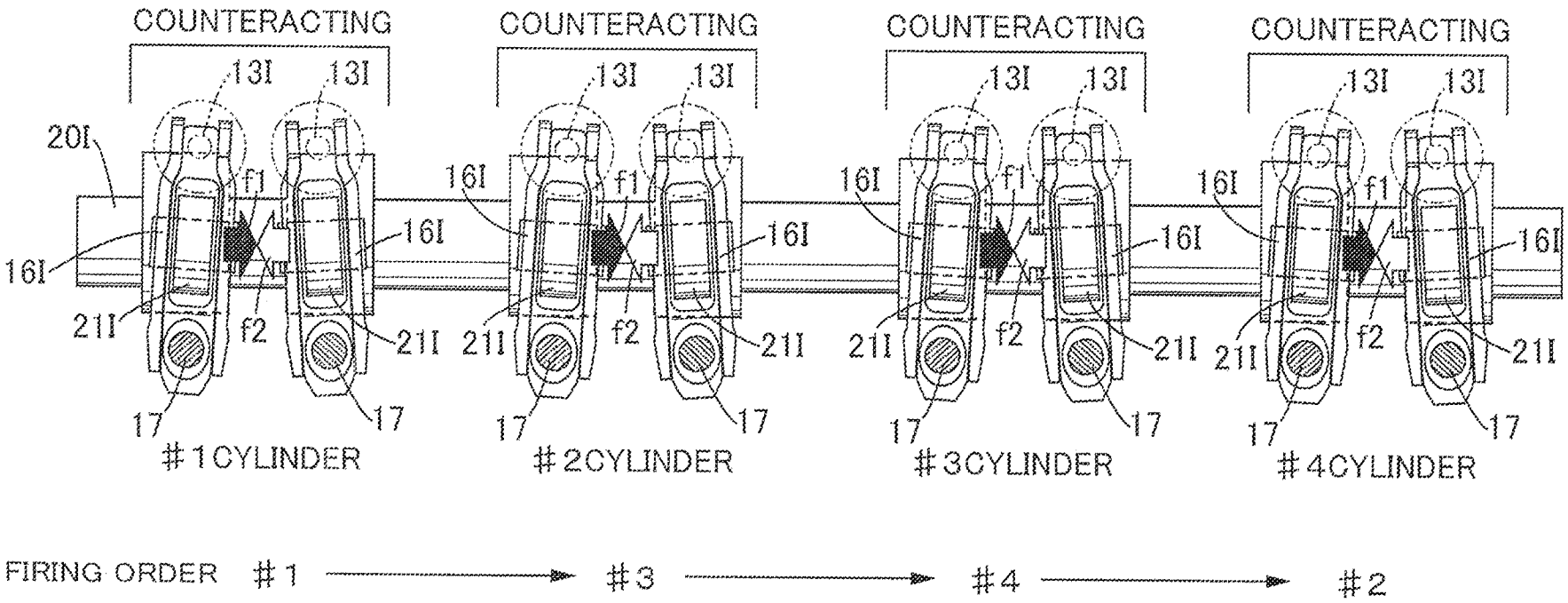
FIG. 3 is a view from arrowed line 3-3 in FIG. 1. (first embodiment)

As shown in FIG. 1 to FIG. 3, a pair of air intake ports 11*a* are formed for each cylinder 12 in a cylinder head 11 of an in-line four cylinder engine, and the pair of air intake ports 11*a* are opened and closed by means of a pair of air intake valves 13I. The air intake valve 13I includes a beveled portion 13*a* for opening and closing the air intake port 11*a* and a shaft portion 13*b* slidably guided by a valve guide 14 provided on the cylinder head 11, and is urged in the valve-closing direction by means of a valve spring 15.

An air intake rocker arm 16I that opens and closes the air intake valve 13I is of a swing arm type; the fulcrum at one end thereof is swingably supported pivotally on a hydraulic lash adjuster 17 provided on an upper face of the cylinder head 11, the point of action at the other end thereof abuts against the tip end part of the shaft portion 13*b* of the air intake valve 13I, and a roller 18 is provided on an intermediate part in the longitudinal direction. An air intake camshaft 20I is rotatably supported between a cam holder 11*b* formed integrally with an upper part of the cylinder head 11 and a cam cap 19 fastened to the cam holder 11*b*. An air intake cam 21I is provided on the air intake camshaft 20I, the air intake cam 21I abutting against a roller 18 of the air intake rocker arm 16I.

As is clear from FIG. 2, the pair of air intake rocker arms 16I of each cylinder 12 are inclined at an angle θ in opposite directions to each other with respect to a direction orthogonal to a camshaft axis L2 when viewed in the direction of a cylinder axis L1. Therefore, when viewed in the cylinder axis L1 direction, the pair of air intake rocker arms 16I of each cylinder 12 are disposed in a truncated chevron shape. Hereinafter, the arrangement of the truncated chevron shape of the pair of air intake rocker arms 16I is called an inclinationally symmetrical arrangement. The inclinationally symmetrical arrangement of the pair of air intake rocker arms 16I is realized by increasing the gap of the pair of hydraulic lash adjusters 17.

Due to the above arrangement, the air intake camshaft 20I rotates once while the crankshaft rotates twice, and when the cam noses of the air intake cams 21I push the rollers 18 once while the air intake camshaft 20I rotates once, the air intake rocker arms 16I swings in one direction with the hydraulic lash adjusters 17 as the fulcrum, and the pair of air intake valves 13I thereby open while compressing the valve springs 15. When the cam noses of the air intake cams 21I go past the rollers 18, the pair of air intake valves 13I are closed by virtue of the resilient force of the compressed valve springs 15. In the present embodiment, the firing order of the four cylinders 12, that is, the order of operation of the air intake rocker arms 16I, is the order: #1 cylinder→#3 cylinder→#4 cylinder→#2 cylinder.

The operation of the first embodiment of the present invention having the above arrangement is now explained.

When the pair of air intake cams 21I of each cylinder 12 push the rollers 18 of the pair of air intake rocker arms 16I against the resilient force of the valve springs 15 in response to rotation of the air intake camshaft 20I, the pair of air intake cams 21I are subjected to a reaction force load from the rollers 18. In this process, as shown in FIG. 3, since the pair of air intake rocker arms 16I of each cylinder 12 are disposed in the truncated chevron-shaped inclinationally symmetrical arrangement, a load f1 transmitted from the roller 18 of one air intake rocker arm 16I to the air intake camshaft 20I and a load f2 transmitted from the roller 18 of the other air intake rocker arm 16I to the air intake camshaft 20I are of the same magnitude but in opposite directions to each other, and the two reaction force loads f1 and f2 counteract each other. In this way, the two reaction force loads f1 and f2 of each cylinder 12 counteract each other, thus preventing a thrust load from acting on the air intake camshaft 20I, which would be caused by variation in the angle of inclination of the air intake rocker arms 16I, and thereby stabilizing the position in the axial direction of the air intake camshaft 20I. As a result, the air intake camshaft 20I is prevented from colliding with the cam holder 11*b* and generating a knocking sound.

It is not necessary to apply the inclinationally symmetrical arrangement of the pair of air intake rocker arms 16I described above to all four of the cylinders 12, and it may be applied to specified cylinders 12 among the four cylinders 12.

In the graphs of FIG. 4A to FIG. 4F, the abscissa is the rotational angle of the crankshaft and the ordinate is the thrust load of the air intake camshaft 20I; the four peaks of the thrust load correspond, in sequence from the left, to the thrust load due to #1 cylinder, the thrust load due to #3 cylinder, the thrust load due to #4 cylinder, and the thrust load due to #2 cylinder.

FIG. 4A is a case in which the inclinationally symmetrical arrangement of the pair of air intake rocker arms 16I is not applied at all, and the thrust load of the air intake camshaft 20I due to each cylinder 12 is large for all of them. FIG. 4F is a case in which the inclinationally symmetrical arrangement of the pair of air intake rocker arms 16I is applied to all of the cylinders 12, and the thrust load of the air intake camshaft 20I due to each cylinder 12 is small for all of them.

FIG. 4B is a case in which the inclinationally symmetrical arrangement of the pair of air intake rocker arms 16I is applied to one cylinder 12 (#2 cylinder) among the four cylinders 12, and it can be seen that the thrust load generated by #1 cylinder is decreased. FIG. 4C is a case in which the inclinationally symmetrical arrangement of the pair of air intake rocker arms 16I is applied to two cylinders 12 for which the firing order is consecutive (that is, #4 cylinder and #2 cylinder, for which the order of operation of the air intake rocker arms 16I is consecutive) among the four cylinders 12, and it can be seen that the thrust load generated by #1 cylinder and #2 cylinder is decreased.

FIG. 4D is a case in which the inclinationally symmetrical arrangement of the pair of air intake rocker arms 16I is applied to two cylinders 12 for which the firing order is not consecutive (that is, #0 cylinder and #3 cylinder, for which the order of operation of the air intake rocker arms 16I is not consecutive) among the four cylinders 12, and it can be seen that the thrust load generated by #1 cylinder and #4 cylinder is decreased. FIG. 4E is a case in which the inclinationally symmetrical arrangement of the pair of air intake rocker arms 16I is applied to three cylinders 12 (#2 cylinder, #3 cylinder, and #4 cylinder) among the four cylinders 12, and it can be seen that the thrust load generated by #1 cylinder, #2 cylinder, and #4 cylinder is decreased.

The graph of FIG. 4G shows the relationship between the number of cylinders 12 to which the air intake rocker arms 16I with the inclinationally symmetrical arrangement is applied and the peak value of the thrust load acting on the air intake camshaft 20I. Although it is clear that the peak value of the thrust load is generated in the cylinders 12 to which the inclinationally symmetrical arrangement of the air intake rocker arms 16I is not applied, the peak value of the thrust load decreases further as the number of the cylinders 12 to which the inclinationally symmetrical arrangement of the air intake rocker arms 16I is applied increases.

The reason therefore is that, if the firing order of the cylinders 12 is in the order: cylinder 12 to which the inclinationally symmetrical arrangement is applied→cylinder 12 to which the inclinationally symmetrical arrangement is not applied, the effect in decreasing the thrust load due to the cylinder 12 to which the inclinationally symmetrical arrangement is applied reaches the cylinder 12 to which the inclinationally symmetrical arrangement is not applied, and the peak value of the thrust load of the cylinder 12 thereby decreases.

The valve operating system on the air intake side of the engine is explained above, but the technical scope of the first embodiment can be applied to a valve operating system on the exhaust side of the engine, that is, a valve operating system in which an exhaust valve is driven by an exhaust camshaft via an exhaust rocker arm, without any modifications.

Furthermore, in the first embodiment the inclinationally symmetrical arrangement for the air intake rocker arms 16I is applied to all of the cylinders 12, but the inclinationally symmetrical arrangement for the air intake rocker arms 16I may be applied only to a specified cylinder 12.

Second Embodiment

Figure 5:
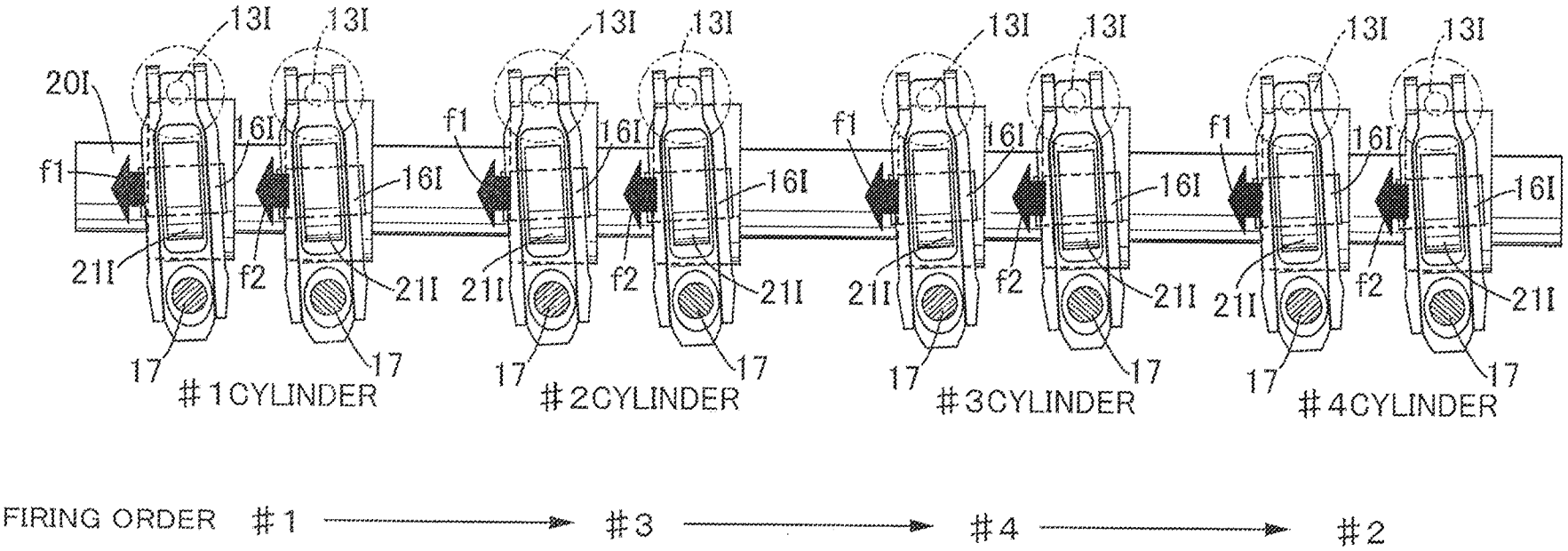
FIG. 5 is a view corresponding to FIG. 2. (second embodiment)

A second embodiment of the present invention is explained below by reference to FIG. 5. The second embodiment corresponds to the invention of claim 2 of the present application.

In the second embodiment, the pair of air intake rocker arms 16I of all of the cylinders 12 are inclined at the same angle in the same direction as each other with respect to a direction orthogonal to the camshaft axis L2 when viewed in the cylinder axis L1 direction. That is, when viewed in the cylinder axis L1 direction, the pair of air intake rocker arms 16I of each cylinder 12 are disposed in an inclinationally parallel state. The inclinationally parallel arrangement of the pair of air intake rocker arms 16I is realized by moving the positions of the pair of hydraulic lash adjusters 17 in the same direction in the camshaft axis L2 direction.

Due to this arrangement, when the pair of air intake cams 21I of each cylinder 12 push the rollers 18 of the pair of air intake rocker arms 16I against the resilient force of the valve springs 15 in response to rotation of the air intake camshaft 20I, and the pair of air intake cams 21I are subjected to a reaction force load from the rollers 18, since the pair of air intake rocker arms 16I of each cylinder 12 are disposed inclinationally parallel to each other, the load f1 transmitted from the roller 18 of one air intake rocker arm 16I to the air intake camshaft 20I and the load 12 transmitted from the roller 18 of the other air intake rocker arm 16I to the air intake camshaft 20I act in the same direction. Moreover, since the directions of the thrust loads acting on the air intake camshaft 20I from the air intake rocker arms 16I of each cylinder 12 are the same direction, the air intake camshaft 20I is always pushed against the cam holder 11*b* of the cylinder head 11 in a fixed direction, thus making it possible to stabilize the position of the air intake camshaft 20I and prevent a knocking sound from occurring.

The valve operating system on the air intake side of the engine is explained above, but the technical scope of the second embodiment can be applied to a valve operating system on the exhaust side of the engine, that is, a valve operating system in which an exhaust valve is driven by an exhaust camshaft via an exhaust rocker arm, without any modifications.

Furthermore, in the second embodiment the inclinationally parallel arrangement for the air intake rocker arms 16I is applied to all of the cylinders 12, but the inclinationally parallel arrangement for the air intake rocker arms 16I may be applied only to a specified cylinder 12.

Third Embodiment

Figure 6:
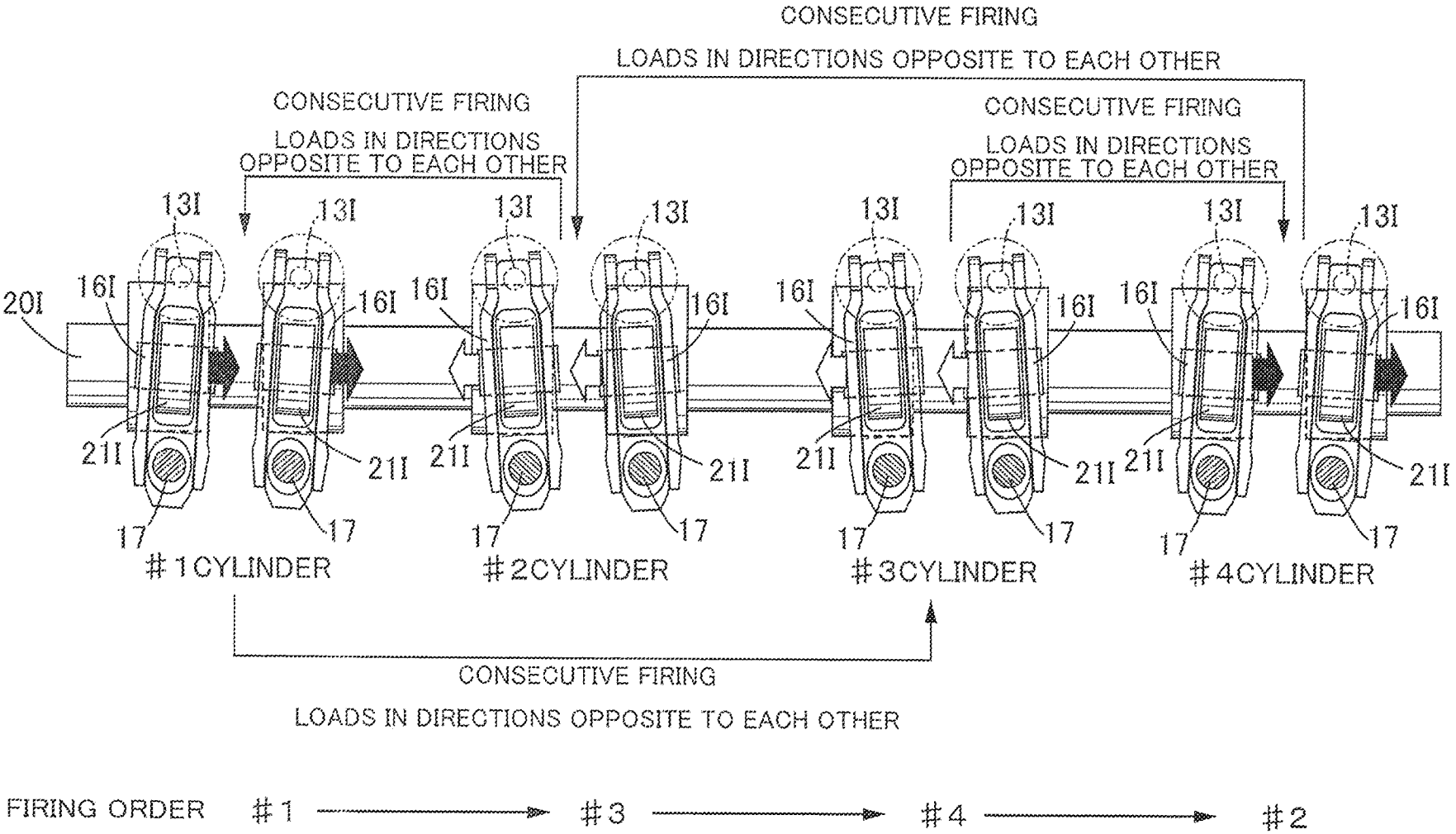
FIG. 6 is a view corresponding to FIG. 2. (third and fourth embodiments)

A third embodiment of the present invention is now explained by reference to FIG. 6. The third embodiment corresponds to the invention of claim 3 or claim 4 of the present application.

In the first embodiment, the pair of air intake rocker arms 16I of each cylinder 12 are disposed in a truncated chevron shape, but in the third embodiment the pair of air intake rocker arms 16I of each cylinder 12 are inclined at the same angle in parallel in the same direction with respect to a direction orthogonal to the camshaft axis L2. The direction of inclination of the inclinationally parallel arrangement of the pair of air intake rocker arms 16I is different for each of the cylinders 12, and in FIG. 6 #1 cylinder is set to be in a clockwise direction, #2 cylinder is in a counterclockwise direction, #3 cylinder is in a counterclockwise direction, and #4 cylinder is in a clockwise direction.

Since the firing order of the four cylinders 12 is #1 cylinder→#3 cylinder→#4 cylinder→#2 cylinder, #1 cylinder and #3 cylinder fire consecutively, but since the directions of inclination of the pairs of air intake rocker arms 16I of #1 and #3 cylinders are opposite to each other, the thrust loads on the air intake camshaft 20I generated by the air intake rocker arms 16I of #1 and #3 cylinders counteract each other, and the position in the axial direction of the air intake camshaft 20I is stabilized.

Similarly, #3 cylinder and #4 cylinder fire consecutively, but since the directions of inclination of the pair of air intake rocker arms 16I of #3 and #4 cylinders are opposite to each other, the thrust loads on the air intake camshaft 20I generated by the air intake rocker 16I of #3 and #4 cylinders counteract each other, and the position in the axial direction of the air intake camshaft 20I is stabilized.

As described above, when the pair of air intake rocker arms 16I of each cylinder 12 of a multicylinder engine are in the inclinationally parallel arrangement, and the directions of inclination of the pair of air intake rocker arms 16I of the two cylinders 12 that fire consecutively are opposite to each other, the thrust loads can be counteracted and movement of the air intake camshaft 20I can be suppressed, and when the directions of inclination of the pair of air intake rocker arms 16I of the two cylinders 12 that fire consecutively are the same directions, the thrust loads are added and the air intake camshaft 20I is pushed against the cam holder 11*b* of the cylinder head 11, thus preventing a knocking sound from occurring.

The valve operating system on the air intake side of the engine is explained above, but the technical scope of the third embodiment can be applied to a valve operating system on the exhaust side of the engine, that is, a valve operating system in which an exhaust valve is driven by an exhaust camshaft via an exhaust rocker arm, without any modifications.

Fourth Embodiment

Figure 7:
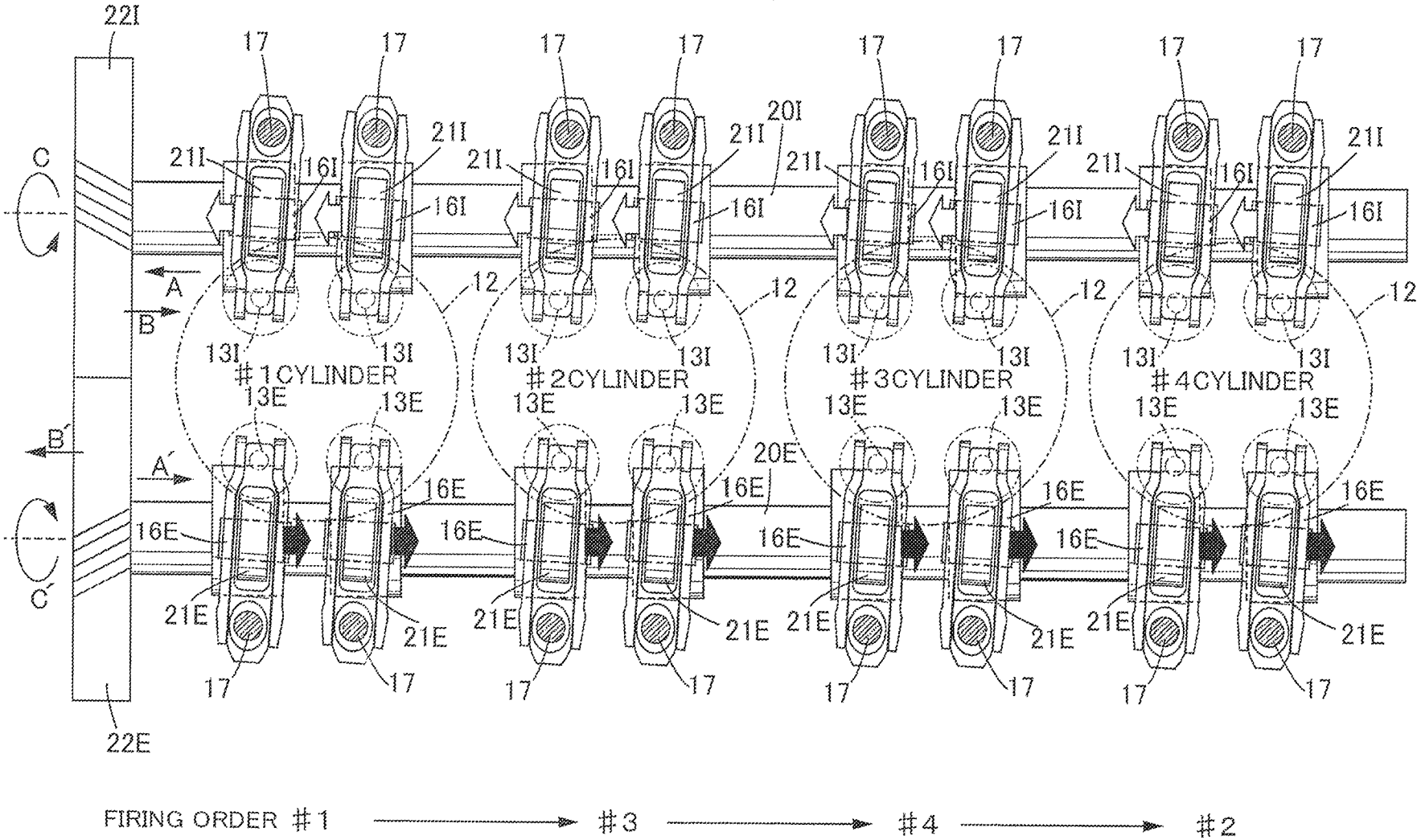
FIG. 7 is a view corresponding to FIG. 2. (fourth embodiment)

A fourth embodiment of the present invention is now explained by reference to FIG. 7. The fourth embodiment corresponds to the invention of claim 5 of the present application.

The fourth embodiment includes, in addition to the valve operating system on the air intake side, a valve operating system on the exhaust side that includes exhaust valves 13E, an exhaust camshaft 20E, exhaust cams 21E, and exhaust rocker arms 16E, and the effects are exhibited by cooperation of the valve operating system on the air intake side and the valve operating system on the exhaust side.

Since the pair of air intake rocker arms 16I of each cylinder 12 are disposed inclinationally parallel to each other, and the direction of inclination of the air intake rocker arms 16I is identical for all of the cylinders 12, the air intake camshaft 20I is urged in the direction of arrow A by means of the reaction force load from the air intake rocker arms 16I. Furthermore, since the pair of exhaust rocker arms 16E of each cylinder 12 are disposed inclinationally parallel to each other, and the directions of inclination of the exhaust rocker arms 16E of all of the cylinders 12 are the same, the exhaust camshaft 20E is urged in the direction shown by arrow A' by means of the reaction force load from the exhaust rocker arms 16E. That is, the direction A in which the air intake camshaft 20I is urged and the direction A' in which the exhaust camshaft 20E is urged are opposite to each other.

An air intake helical gear 22I fixedly provided at the shaft end of the air intake camshaft 20I and an exhaust helical gear 22E fixedly provided at the shaft end of the exhaust camshaft 20E mesh with each other, and the air intake cam 21I and the exhaust cam 21E rotate at the same speed in opposite directions to each other as shown by arrows C and C'. In this process, since the air intake helical gear 22I and the exhaust helical gear 22E mesh with each other by means of inclined teeth, a meshing reaction force in the direction of arrow B acts on the air intake camshaft 20I, and a meshing reaction force in the direction of arrow B' acts on the exhaust cam 21E.

Since the thrust load A acting on the air intake camshaft 20I from the air intake rocker arms 16I and the thrust load B acting on the air intake camshaft 20I from the air intake helical gear 22I are in opposite directions to each other, they counteract each other, thereby reducing the total thrust load acting on the air intake camshaft 20I. Furthermore, since the thrust load A' acting on the exhaust camshaft 20E from the exhaust rocker arms 16E and the thrust load B' acting on the exhaust camshaft 20E from the exhaust helical gear 22E are in opposite directions to each other, they counteract each other, thereby reducing the total thrust load acting on the exhaust camshaft 20E.

In this way, due to the thrust load acting on the air intake camshaft 20I and the exhaust camshaft 20E being reduced, the positions in the axial direction of the air intake camshaft 20I and the exhaust camshaft 20E are stabilized, and the occurrence of a knocking sound due to movement of the air intake camshaft 20I and the exhaust camshaft 20E is prevented.

Fifth Embodiment

Figure 8:
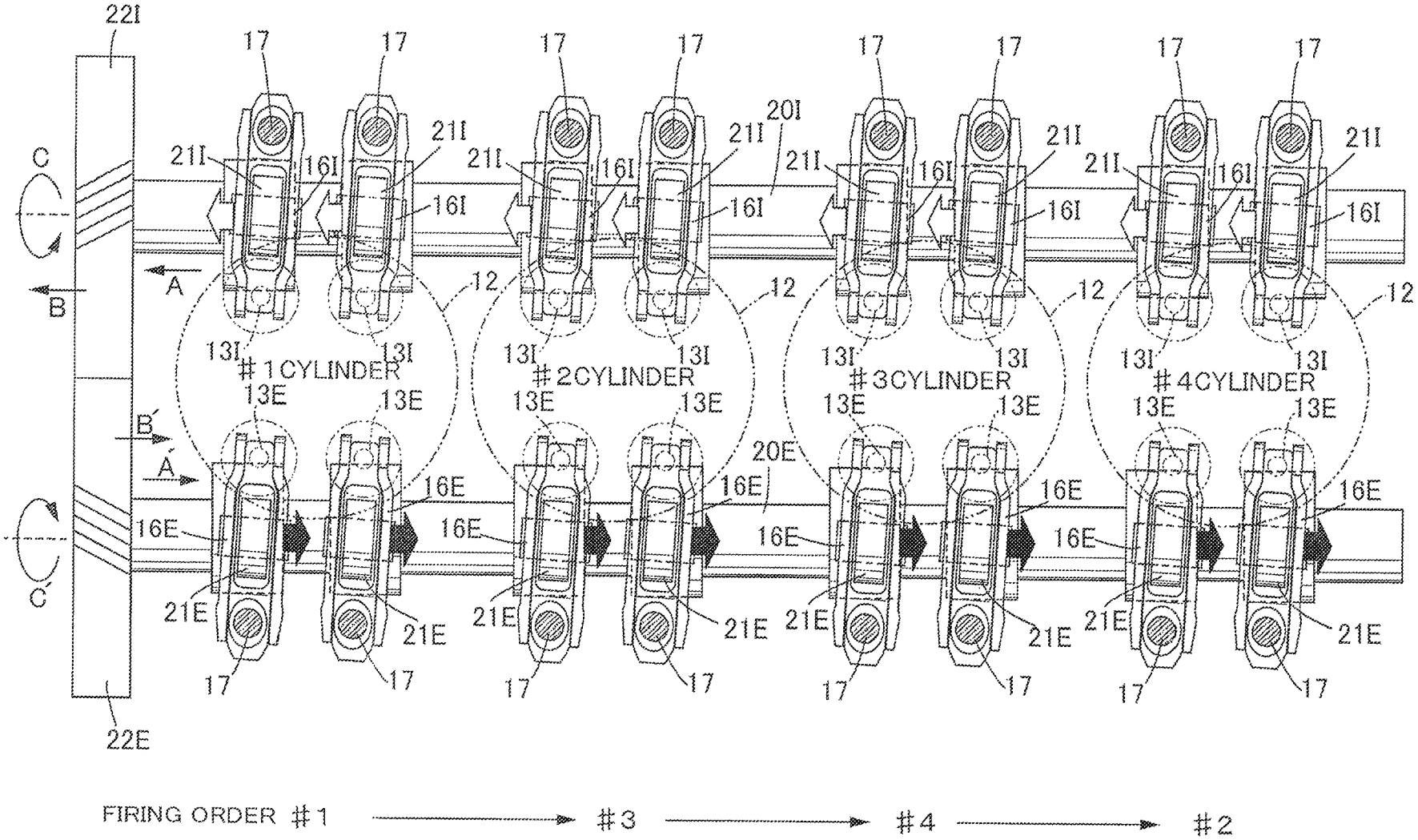
FIG. 8 is a view corresponding to FIG. 2. (fifth embodiment)

A fifth embodiment of the present invention is now explained by reference to FIG. 8. The fifth embodiment corresponds to the invention of claim 6 of the present application.

The fifth embodiment is a modification of the fourth embodiment; the directions of inclination of teeth of the air intake helical gear 22I and the exhaust helical gear 22E are opposite directions, and the direction of the thrust load B formed from the meshing reaction force that the air intake helical gear 22I is subjected to therefore coincides with the direction of the thrust load A that the air intake camshaft 20I is subjected to from the air intake rocker arms 16I, and the direction of the thrust load B' formed from the meshing reaction force that the exhaust helical gear 22E is subjected to coincides with the direction of the thrust load A' that the exhaust camshaft 20E is subjected to from the exhaust rocker arms 16E.

As a result, the air intake camshaft 20I is pushed against the cam holder 11*b* of the cylinder head 11 by means of the resultant force of the two thrust loads A and B, thereby stabilizing the position in the axial direction, and the exhaust camshaft 20E is pushed against the cam holder 11*b* of the cylinder head 11 by means of the resultant force of the two thrust loads A' and B' thereby stabilizing the position in the axial direction.

Sixth Embodiment

Figure 9B:
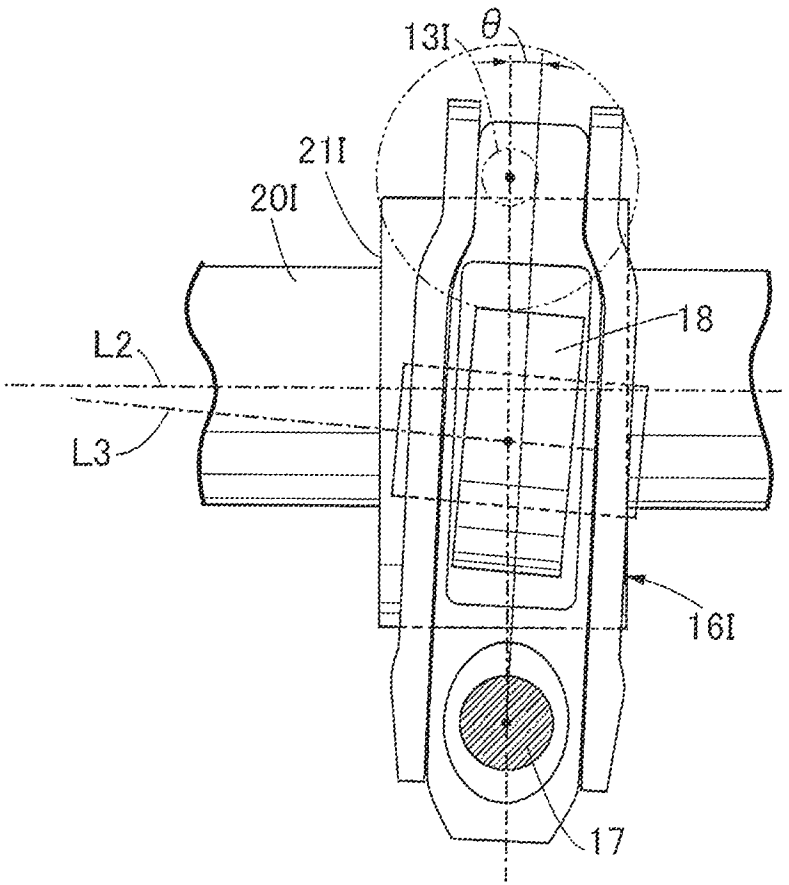
FIGS. 9A and 9B are diagrams for explaining another method for inclining the rocker arm. (sixth embodiment)
Figure 9A:
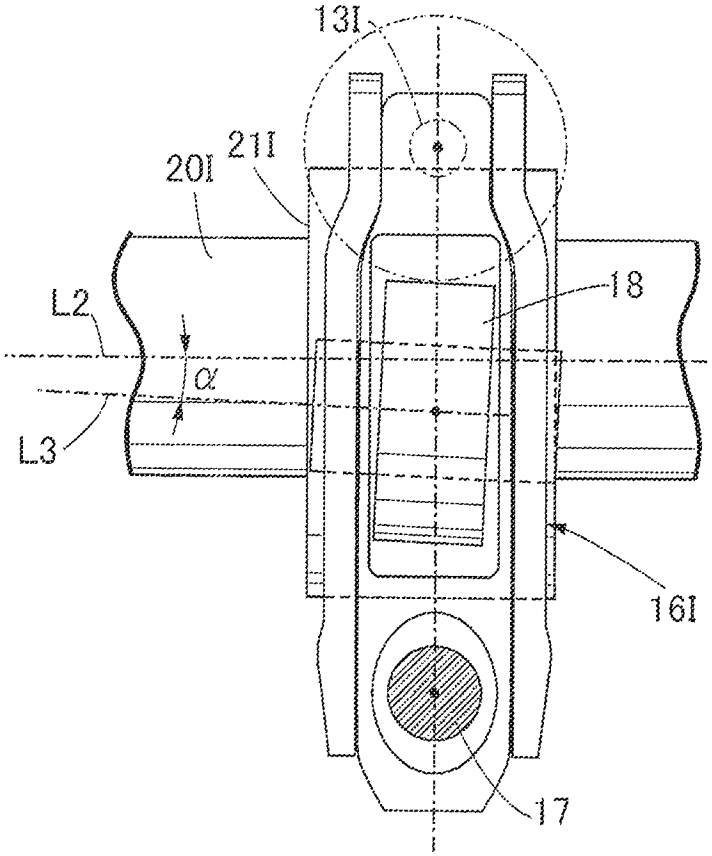

A sixth embodiment of the present invention is now explained by reference to FIGS. 9A and 9B.

In the first to fifth embodiments described above, the air intake rocker arm 16I (or the exhaust rocker arm 16E) is inclined by moving the position of the hydraulic lash adjuster 17, but in the sixth embodiment the air intake rocker arm 16I (or the exhaust rocker arm 16E) is inclined by another method.

The air intake rocker arm 16I is used as an example for explanation. As shown in FIG. 9A, an axis L3 of the roller 18 is inclined in advance only by an angle $\alpha$ with respect to the camshaft axis L2. As shown in FIG. 9B, when the air intake cam 21I abuts against the roller 18 of the air intake rocker arm 16I, the load that the roller 18 is subjected to from the air intake cam 21I inclines the air intake rocker arm 16I by an angle θ, within the range of play, with respect to a direction orthogonal to the camshaft axis L2, and in the same manner as in the first to fifth embodiments a thrust load can be actively made to act on the air intake camshaft 20I from the air intake rocker arm 16I.

Embodiments of the present invention are explained above, but the present invention may be modified in a variety of ways as long as the modifications do not depart from the gist of the present invention.

For example, the present multicylinder engine of the present invention is not limited to the in-line four cylinder engine of the embodiments and may be applied to, for example, an in-line multicylinder engine other than a four cylinder engine, or a V type multicylinder engine in which each bank is multicylinder.

Furthermore, the rocker arm of the present invention is not limited to the swing arm type of the embodiments that includes the fulcrum that abuts against the hydraulic lash adjuster at one end, the point of action that abuts against the valve at the other end, and the point of effort that abuts against the cam in an intermediate part, and may be of a seesaw type that includes the fulcrum in an intermediate part and the point of effort and the point of action at opposite ends.

Moreover, in order to realize the inclinationally symmetrical arrangement of the pair of air intake rocker arms 16I, the distance between the pair of air intake valves 13I may be set to be larger than the distance between the pair of hydraulic lash adjusters 17. The same may be applied to the inclinationally symmetrical arrangement of the pair of exhaust rocker arms 16E.

Furthermore, in the inclinationally symmetrical arrangement of the pair of air intake rocker arms 16I or the pair of exhaust rocker arms 16E it is not necessary for the inclination angles θ of the two rocker arms to coincide with each other, and in the inclinationally parallel arrangement it is also not necessary for the inclination angles θ of the two rocker arms to coincide with each other.

Moreover, the rocker arm of the present invention is not limited to one that includes the roller 18 of the embodiments and may be one that includes a slipper instead of the roller 18.

Furthermore, in the embodiments the hydraulic lash adjuster 17 is used as the fulcrum of the rocker arm, but it is not limited thereto.

What is claimed is:

1. A valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, and directions of inclination of the rocker arms of two of the cylinders for which a firing order is consecutive are in opposite directions to each other.

2. The valve operating system for a multicylinder engine according to claim 1, wherein one rocker arm of a pair of rocker arms is inclined with respect to a direction orthogonal to the camshaft axis by displacing a position of a fulcrum of the one rocker arm of a pair of rocker arms in a direction of the camshaft axis.

3. The valve operating system for a multicylinder engine according to claim 1, wherein one rocker arm of a pair of rocker arms comprises a roller that abuts against the cam, and the one rocker arm of a pair of rocker arms is inclined with respect to a direction orthogonal to the camshaft axis by inclining an axis of the roller with respect to a longitudinal direction of the one rocker arm of a pair of rocker arms.

4. A valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, a direction of inclination of one rocker arm of a pair of rocker arms driven by the camshaft on an air intake side and a direction of inclination of the other rocker arm of a pair of rocker arms driven by the camshaft on an exhaust side are in a same direction as each other, a helical gear on the air intake side provided on the camshaft on the air intake side and a helical gear on the exhaust side provided on the camshaft on the exhaust side mesh with each other, a thrust load generated by the helical gear on the air intake side is in a direction opposite to that of a thrust load generated by the one rocker arm of a pair of rocker arms on the air intake side, and a thrust load generated by the helical gear on the exhaust side is in a direction opposite to that of a thrust load generated by the other rocker arm of a pair of rocker arms on the exhaust side.

5. The valve operating system for a multicylinder engine according to claim 4, wherein the one rocker arm of a pair of rocker arms is inclined with respect to a direction orthogonal to the camshaft axis by displacing a position of a fulcrum of the one rocker arm of a pair of rocker arms in a direction of the camshaft axis.

6. The valve operating system for a multicylinder engine according to claim 4, wherein the one rocker arm of a pair of rocker arms comprises a roller that abuts against the cam, and the one rocker arm of a pair of rocker arms is inclined with respect to a direction orthogonal to the camshaft axis by inclining an axis of the roller with respect to a longitudinal direction of the one rocker arm of a pair of rocker arms.

7. A valve operating system for a multicylinder engine, that opens and closes a pair of valves provided on each of cylinders by means of a pair of rocker arms operated by a cam provided on a camshaft supported on a cam holder, wherein when viewed in a direction of a cylinder axis, the pair of rocker arms are inclined in a same direction as each other with respect to a direction orthogonal to a camshaft axis, a direction of inclination of one rocker arm of a pair of rocker arms driven by the camshaft on the air intake side and a direction of inclination of the other rocker arm of a pair of rocker arms driven by the camshaft on the exhaust side are in a same direction as each other, a helical gear on the air intake side provided on the camshaft on the air intake side and a helical gear on the exhaust side provided on the camshaft on the exhaust side mesh with each other, a thrust load generated by the helical gear on the air intake side is in a same direction as that of a thrust load generated by the one rocker arm of a pair of rocker arms on the air intake side, and a thrust load generated by the helical gear on the exhaust side is in a same direction as that of a thrust load generated by the other rocker arm of a pair of rocker arms on the exhaust side.

8. The valve operating system for a multicylinder engine according to claim 7, wherein the one rocker arm of a pair of rocker arms is inclined with respect to a direction orthogonal to the camshaft axis by displacing a position of a fulcrum of the one rocker arm of a pair of rocker arms in a direction of the camshaft axis.

9. The valve operating system for a multicylinder engine according to claim 7, wherein the one rocker arm of a pair of rocker arms comprises a roller that abuts against the cam, and the one rocker arm of a pair of rocker arms is inclined with respect to a direction orthogonal to the camshaft axis by inclining an axis of the roller with respect to a longitudinal direction of the one rocker arm of a pair of rocker arms.

* * * * *